United States Patent [19]

Ishikawa et al.

[11] Patent Number: 4,946,152

[45] Date of Patent: Aug. 7, 1990

[54] SORTER-FINISHER

[75] Inventors: Takuma Ishikawa; Kuniaki Ishiguro; Toshio Matsui, all of Osaka; Kazuhito Ozawa, Toyokawa, all of Japan

[73] Assignee: Minolta Camera Kabushiki Kaisha, Osaka, Japan

[21] Appl. No.: 239,290

[22] Filed: Sep. 1, 1988

[30] Foreign Application Priority Data

Sep. 4, 1987 [JP] Japan ..... 62-222368

[51] Int. Cl.[5] ..... B42B 1/02

[52] U.S. Cl. ..... 270/53; 270/58; 271/31

[58] Field of Search ..... 270/37, 53, 52, 58; 271/3, 3.1; 355/308, 321, 322, 323, 324

[56] References Cited

U.S. PATENT DOCUMENTS

| | | | |
|---|---|---|---|
| 3,386,729 | 6/1968 | Pine | 270/525 |
| 3,645,615 | 2/1972 | Spear | 355/3 |
| 3,697,063 | 1/1972 | Greenfield et al. . | |
| 3,709,595 | 1/1973 | Turner et al. | 355/14 |
| 3,944,207 | 3/1976 | Bains | 270/58 |
| 4,067,649 | 1/1978 | Hubbard et al. | 355/14 |
| 4,073,391 | 2/1978 | O'Brien et al. | 214/65 |
| 4,076,408 | 2/1978 | Reid et al. | 355/14 |
| 4,123,155 | 10/1978 | Hubert | 355/26 |
| 4,134,672 | 1/1979 | Burlew et al. | 355/14 SH |
| 4,145,037 | 3/1979 | Mol | 270/58 |
| 4,190,246 | 2/1980 | Sasuga | 271/145 |
| 4,203,587 | 5/1980 | Kishi et al. | 271/293 |
| 4,218,128 | 8/1980 | Satomi et al. | 355/14 SH |
| 4,227,275 | 10/1980 | Soderberg | 11/1 R |
| 4,238,066 | 12/1980 | Brooke | 227/39 |
| 4,248,413 | 2/1981 | Fox | 270/53 |
| 4,248,525 | 2/1981 | Sterrett | 355/14 SH |
| 4,265,440 | 5/1981 | Shibazaki et al. | 271/9 |
| 4,272,180 | 6/1981 | Satomi et al. | 355/3 Sh |
| 4,281,920 | 8/1981 | Cross | 355/75 |
| 4,295,733 | 10/1981 | Janssen et al. | 355/14 Sh |
| 4,313,670 | 2/1982 | Caldwell | 355/3 R |
| 4,361,393 | 11/1982 | Noto | 355/3 SH |

(List continued on next page.)

FOREIGN PATENT DOCUMENTS

| | | |
|---|---|---|
| 99250 | 1/1984 | European Pat. Off. . |
| 2732673 | 9/1978 | Fed. Rep. of Germany . |
| 3218747 | 12/1982 | Fed. Rep. of Germany . |
| 3701450 | 7/1987 | Fed. Rep. of Germany . |
| 55-15150 | 3/1981 | Japan . |
| 57-131667 | 8/1982 | Japan . |
| 59-43765 | 3/1984 | Japan . |
| 60-183461 | 9/1985 | Japan . |
| 60-248563 | 12/1985 | Japan . |
| 61-26061 | 6/1986 | Japan . |
| 61-145069 | 7/1986 | Japan . |
| 61-261096 | 11/1986 | Japan . |
| 2185465 | 7/1987 | United Kingdom . |

OTHER PUBLICATIONS

IBM Technial Bulletin, vol. 18, No. 9, 2/76.

*Primary Examiner*—Robert E. Garrett
*Assistant Examiner*—Therese M. Newholm
*Attorney, Agent, or Firm*—Burns, Doane, Swecker & Mathis

[57] ABSTRACT

In a sorter-finisher with a sorting and stapling functions, the sheets ejected from a copying machine are transported and stored one by one into bins which are movable in the vertical direction along a guiding member, after taking out from each of the bins, the sheets are stapled by a stapling device. The guiding member, for preventing sheets on the bins from sliding down, have a first opening through which sheets ejected from the copying machine are fed onto one of the bins located opposite to the first opening and a second opening through which sheets held on one of the bins located opposite to the second opening are taken out. A first gate member provided at the first opening is movable from a closing position where the first gate member closes the first opening to an opening position where the first gate member is out of the first opening. A second gate member provided at the second opening is movable from a closing position where the second gate member closes the second opening to an opening position where the second gate member is out of the second opening.

4 Claims, 9 Drawing Sheets

U.S. PATENT DOCUMENTS 4,365,866 12/1982 Murakami et al. ..... 355/3 SH
4,368,972 1/1983 Naramore ..... 355/14 SH
4,371,155 2/1983 Asterö et al. ..... 270/53
4,376,529 3/1983 George et al. ..... 270/53
4,385,827 5/1983 Naramore ..... 355/14 SH
4,411,515 10/1983 Kukucka et al. ..... 355/14 SH
4,424,963 1/1984 Bartholet et al. ..... 270/53
4,473,425 9/1984 Baughman et al. ..... 156/356
4,497,478 2/1985 Reschenhofer et al. ..... 270/53
4,515,458 5/1985 Masuda et al. ..... 355/3 SH
4,549,804 10/1985 Braun et al. ..... 355/14 SH
4,564,185 1/1986 Hamlin et al. ..... 270/53
4,566,782 1/1986 Britt et al. ..... 355/14 SH
4,573,789 3/1986 Wada ..... 355/14 SH
4,582,421 4/1986 Hamlin et al. ..... 355/72
4,592,651 6/1986 Oikawa et al. ..... 355/72
4,595,187 6/1986 Bober ..... 270/37
4,603,971 8/1986 Kukucka et al. ..... 355/133
4,626,156 12/1986 Baughman et al. ..... 412/33
4,647,034 3/1987 Sawa ..... 271/293
4,647,188 3/1987 Komiya et al. ..... 355/55
4,674,732 6/1987 Hori ..... 270/53
4,674,866 6/1987 Tanaka ..... 355/23
4,687,191 8/1987 Stemmle ..... 270/53
4,702,589 10/1987 Ito ..... 355/14 SH
4,718,657 1/1988 Otter et al. .
4,721,382 1/1988 Ito et al. ..... 355/14 SH
4,730,206 3/1988 Sawada et al. ..... 355/3 Sh
4,743,945 5/1988 Ito et al. ..... 355/14 SH
4,763,889 8/1988 Dei et al. ..... 271/9
4,801,133 1/1989 Ishiguro ..... 270/58

SORTER-FINISHER

BACKGROUND OF THE INVENTION

1. Field of the Invention

The present invention relates to a sorter-finisher, which is attachable so that sheets ejected from a copying machine or the like are distributed and stored into a plurality of bins, whereby one set of the sheets are then taken out of each bin to be stapled by a stapler.

2. Description of Related Art

Recently, responding to the increasing demand for automated paper handling system for the copying machines, the optional systems such as the automatic document feeding system and the sorting system designed for sorting or grouping copied sheets have been developed and commercialized in various types one after another. The users of the copying machines are now requiring the sorter-finisher capable of automatically stapling and stacking sheets which have been distributed in the sorting system, and this type sorter-finisher has already been commercialized for some of large-sized copying machines.

With a conventional sorter, each bin is elevated so as to form an angle in the sheet storing direction. Therefore, in order to prevent sheets stored in each bin from sliding down, a claw for preventing sheets from sliding down is protruded at the rear end of each bin relative to the sheet storing direction. In the case of the claw for preventing sheets from sliding down that is protruded as above, when the sorting function is independently used, there is no problem because sheets have only to be dropped one by one into each bin. However, when the stapling function is used in addition to the sorting function, there is a problem in that one set of sheets, when taken out of each bin, has to go over the claw for preventing sheets from sliding down, resulting in a structurally complex apparatus. For example, the above problem can be solved by providing an arrangement, wherein a guide plate is provided in order to move up from below a bin so as to elevate the end portion of sheets. However, this arrangement requires that a large notch should be formed at the end portion of the bin, thus causing a problem in strength. Further, such a guide plate is allowed to cover only a part of one set of sheets, but not the whole area of one set of sheets relative to the widthwise direction thereof. Therefore, one set of sheets curled downward is difficult to go over the claw with certainty for preventing sheets from sliding down.

SUMMARY OF THE INVENTION

In view of the foregoing, an object of the present invention is to propose a satisfactorily reliable sorter-finisher, which requires neither that a protruding claw for preventing sheets from sliding down should be provided onto each bin nor that a guide plate should be provided so as to elevate one set of sheets stored on the bin, thus obtaining a simple constitution, wherein without deteriorating the bin's strength by providing a large notch to each bin, it is possible to surely take out even curled sheets when taking sheets out of each bin.

To attain the above-mentioned object, a sorter-finisher attachable to an image forming apparatus, according to the present invention, comprises a guiding member extending in a vertical direction; a plurality of bins movable in the vertical direction along said vertical guiding member, each bin including an inclined sheet holding surface for holding sheets thereon, one end of each bin opposed to said guiding member being lower than the other end; a first opening, located in a first position of said guiding member, through which sheets ejected from the image forming apparatus are fed into one said bins located opposite to the first opening; a second opening, located in a second position of said guiding member, through which sheets held on one of said bins located opposite to the second opening are taken out; a stapling device for stapling the sheets taken out through said second opening; a first gate member provided at said first opening and movable from a closing position where the first gate member closes the first opening to an opening position where the first gate member is out of the first opening; and a second gate member provided at said second opening and movable from a closing position where the second gate member closes the second opening to a opening position where the second gate member is out of the second opening.

Accordingly, in the sorting mode, every time one sheet is fed onto the bins, each of the bins sequentially moves step by step in the vertical direction to the first position facing the first opening. In the stapling mode, every time one set of sheets is taken out of the bins, each of the bins sequentially moves step by step to the second position facing the second opening. In this case, the trailing edges of sheets stored on the bins are regulated by the guiding means for preventing sheets from sliding down, whereby the sheets are prevented from sliding down. Further, when a sheet is transported through the first opening onto each of the bins, and when one set of sheets are taken out of each of the bins, the first gate member and the second gate member are moved from the closing position to the opening position, thereby allowing smooth delivery and take-out of sheets.

BRIEF DESCRIPTION OF THE DRAWINGS

These and other objects and features of the present invention will become apparent from the following description taken in conjunction with the preferred embodiments thereof with reference to the accompanying drawings, in which.

FIGS. *7a*, *7b* and *7c* are explanatory drawings showing a sheet take out unit.

DETAILED DESCRIPTION OF A PREFERRED EMBODIMENT

A preferred embodiment of the present invention will be described below with reference to the drawings. (composition of whole system)

Figure 1:
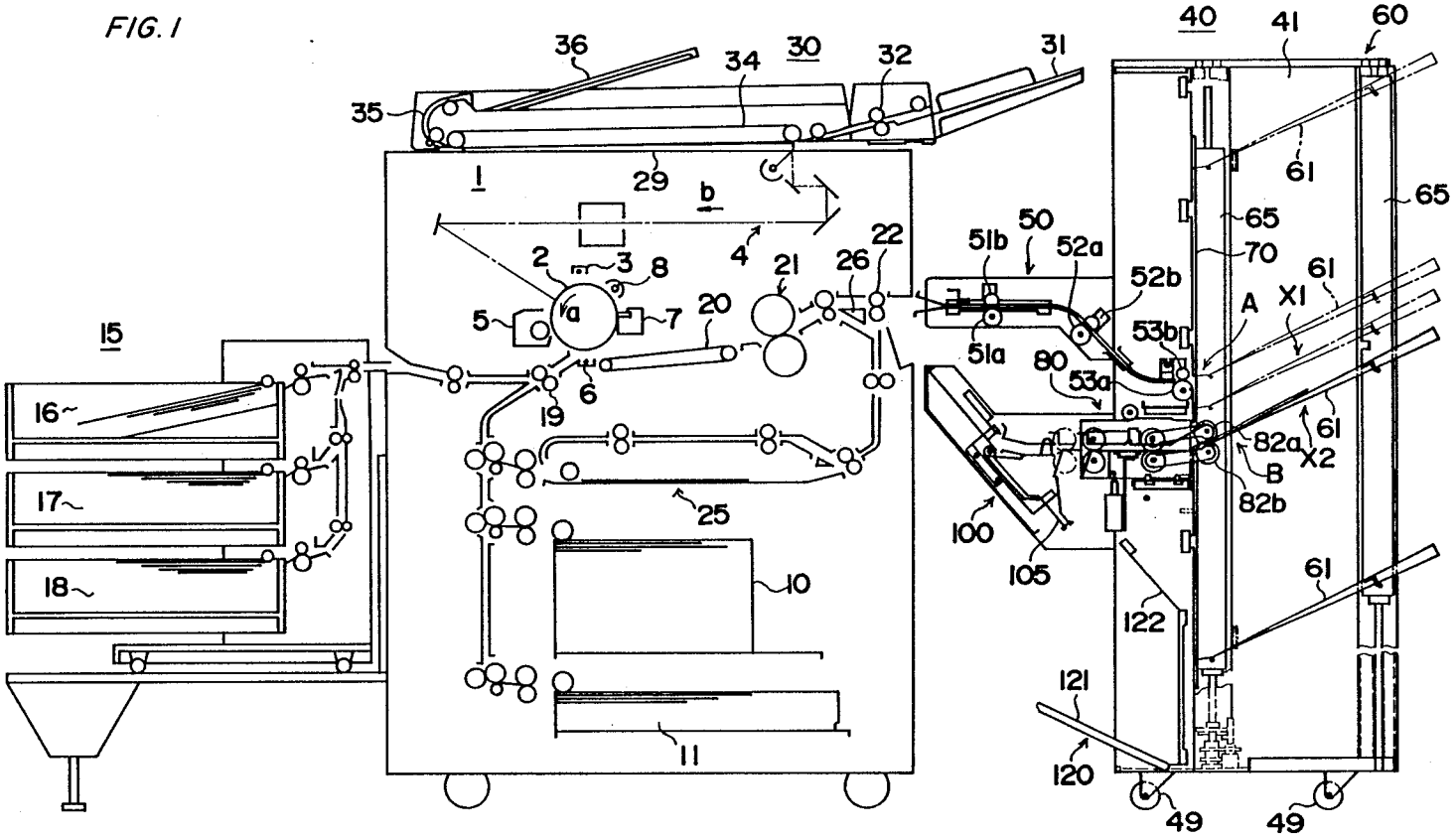
FIG. 1 is a schematic block diagram showing a copying machine and sorter-finisher.

A sorter-finisher 40 according to the invention is designed to be installed on the side of a copying machine 1 as shown in FIG. 1, and the copying machine 1 is provided with an automatic paper feeding unit 15 and an automatic document feeder 30 (hereinafter referred to as ADF).

The copying machine 1 operates on the principle of the commonly known electro-photography. In this copying machine 1, a photosensitive drum 2 to be turned towards the direction of the arrow (a) is charged with a certain amount of static electricity by a static electricity charger 3, and the document set to a specified position by the ADF 30 is exposed to the light through a slit when an optical exposure system 4 scans the document towards the direction of the arrow (b). This causes an electrostatic latent image formed on the photosensitive drum 2 to be developed into a toner image by a magnetic brush type developing device 5 and then transferred onto a sheet by a transfer charger 6.

Copying sheets fed one by one selectively from the elevator type and cassette type automatic paper feeders 10 and 11 built in the copying machine 1 or the 3-stage paper feed cassettes 16, 17 and 18 of the automatic paper feeding unit 15 installed outside the copying machine 1 is transported to a transferring portion by a timing roller couple 19 with specified timing. The sheet carrying the toner image is delivered to a fixing unit 21 by a conveyor belt 20 for fixing the toner image. Then, the sheet is transported to a sorting unit 41 by an ejection roller couple 22.

The copying machine 1 has a built-in paper re-feeder unit 25, which enables duplex copy and composite copy, and a sheet pass selection click 26 is provided before the ejection roller couple 22.

On the other hand, the photosensitive drum 2 is continued to turn towards the direction of the arrow (a) even after the toner image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed documents placed on a document tray 31 one by one using a feed roller couple 32 and is set to a specified position on a glass member 29 of document rest by the rotary motion of a conveyor belt 34 After the exposure of the document image, the document is ejected onto an ejection tray 36 through a transfer pass 35 as the conveyor belt 34 turns.

(composition and operation of sorter-finisher)

Figure 2:
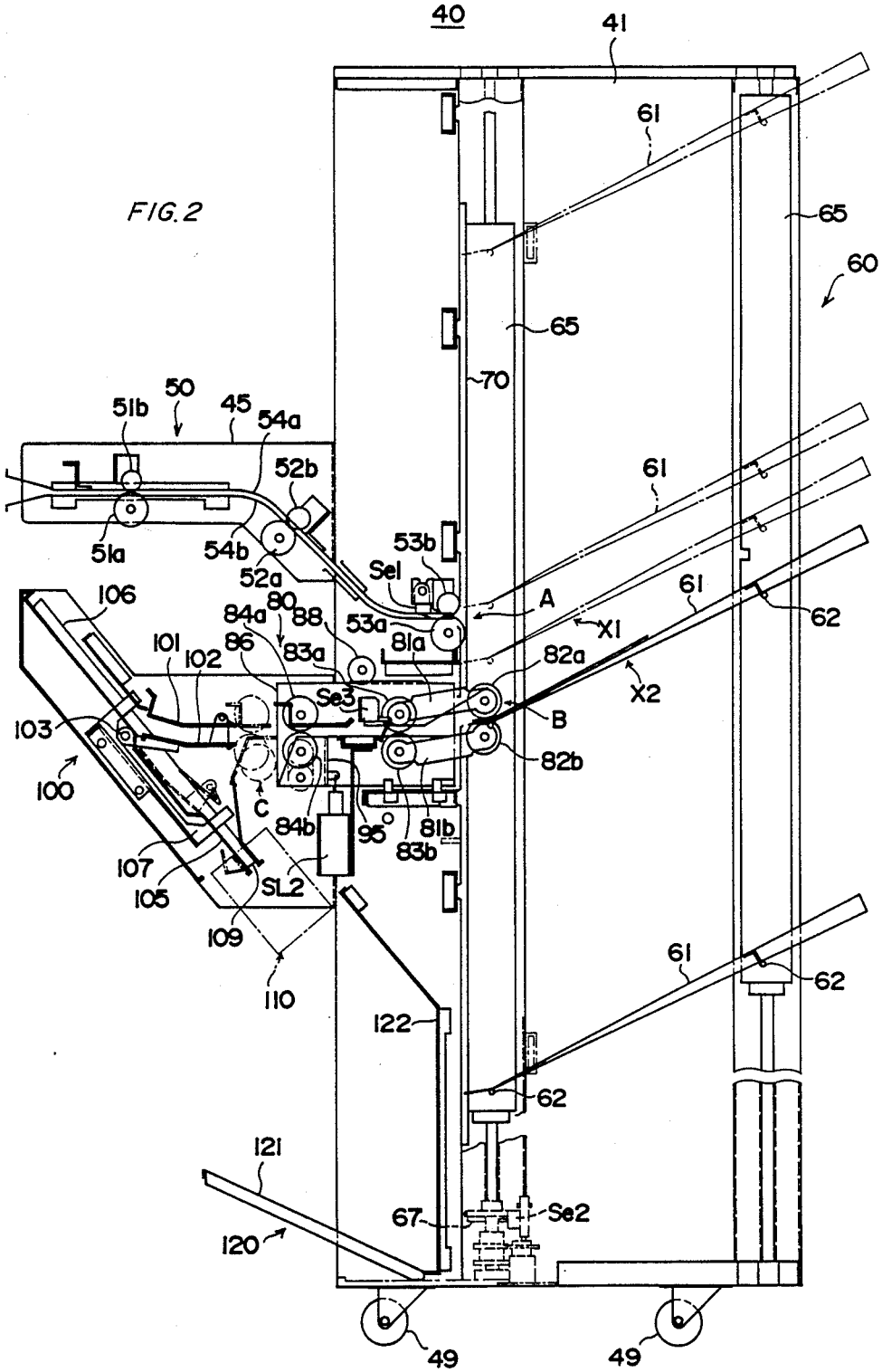
FIG. 2 is an internal composition of the sorter-finisher.

As shown in FIG. 2, the sorter-finisher 40 generally comprises a transport unit 50 for transporting sheets into each bin 61; a sorter unit 60 having a plurality of bins 61; sheet take out unit 80 for taking out one set of sheets stored in each of the bins 61; stapling unit 100 for stapling one set of sheets; and a stack unit 120 for stacking and storing the one set of sheets having been stapled. This sorter-finisher 40, whose frame 41 is held by casters 49 and 49, is secured so as to be connected to the copying machine 1.

The transport unit 50 comprises receiving rollers **51*a* mounted onto a frame 45, pinch rollers 51*b*, intermediate rollers 52*a*, pinch rollers 52*b*, sheet delivering rollers 53*a* attached inside the frame 41, pinch rollers 53*b*, guide plates 54*a* and 54*b* for guiding sheets, and a sheet detection sensor Sel provided immediately before the rollers 53*a* and 53*b*. The ends of the individual guide plates 54*a* and 54*b* are faced the ejection roller couple 22 in the copying machine 1. Each of the rollers 51*a*, 52*a*, and 53*a* is rotated by an unshown motor, and each of the pinch rollers 51*b*, 52*b* and 53*b* being in contact with the rollers 51*a*, 52*a* and 53*a* rotate following the rotation of the rollers 51*a*, 52*a* and 53*a***.

A sheet having an image formed thereon in the copying machine 1 and having been ejected from the ejection roller couple 22, is received by the ends of the respective guide plates **54*a* and 54*b*, and guided through the rollers 51*a*, 51*b*, 52*a* and 52*b*, whereby the sheet is then transported and stored into one of the bins 61 from the rollers 53*a* and 53*b*. In this case, the sheet being delivered from the rollers 53*a* and 53*b*** is detected by the sensor Sel.

The sorter unit 60 comprises a plurality of the bins 61; spiral cams 65 which hold and move each of the bins 61 in the vertical direction; pairs of guide plates 69 and 69 for guiding the movement of each of the bins 61; guiding members 70 for preventing sheets stored in the bins 61 from sliding back, which regulates the trailing edges of the sheets relative to the sheet storing direction; and gate members 72 and 75 which open and close a sheet delivering portion (A) and a sheet taking out portion (B).

Figure 3:
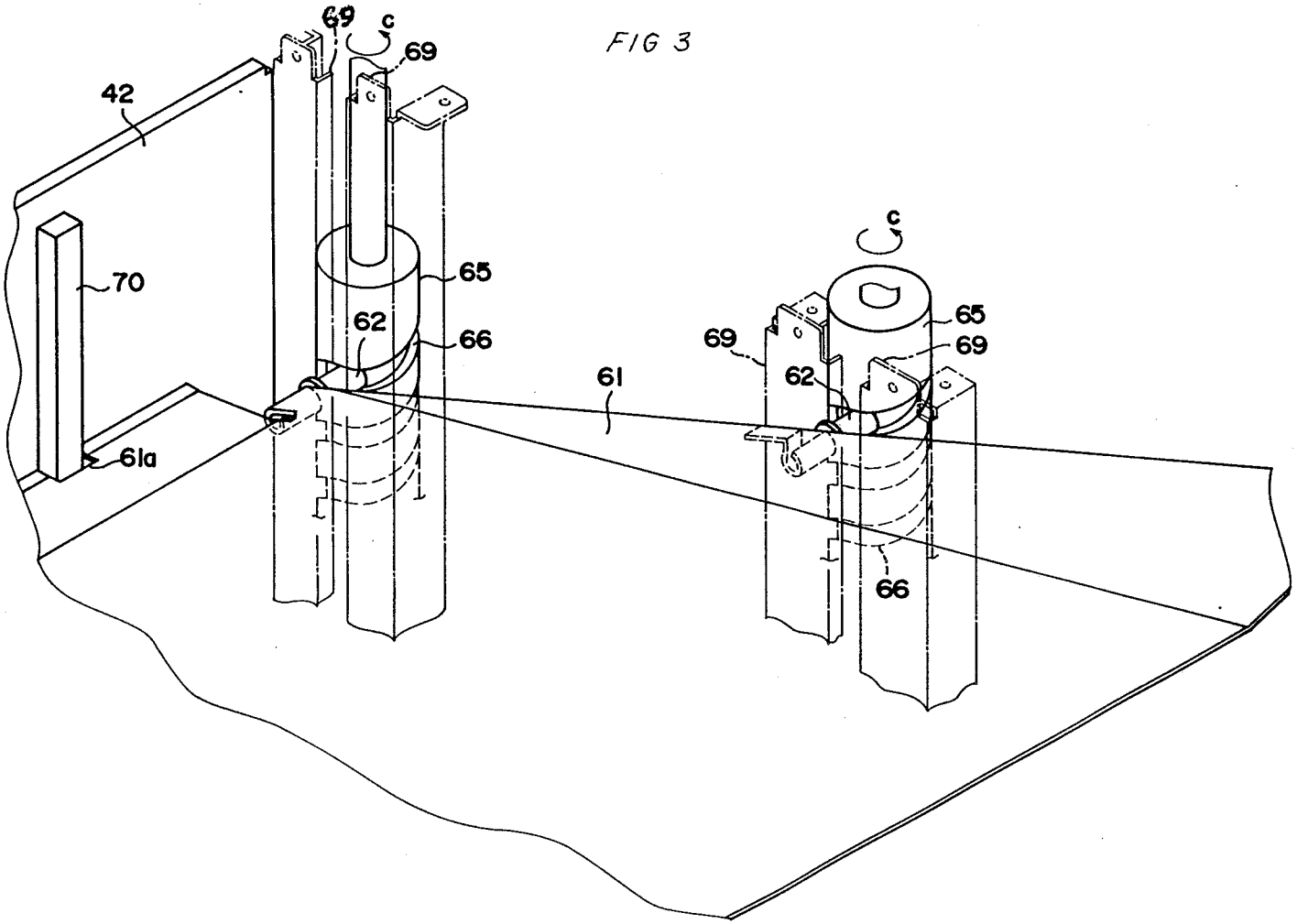
FIG. 3 is a perspective view of a bin driving mechanism.
Figure 4:
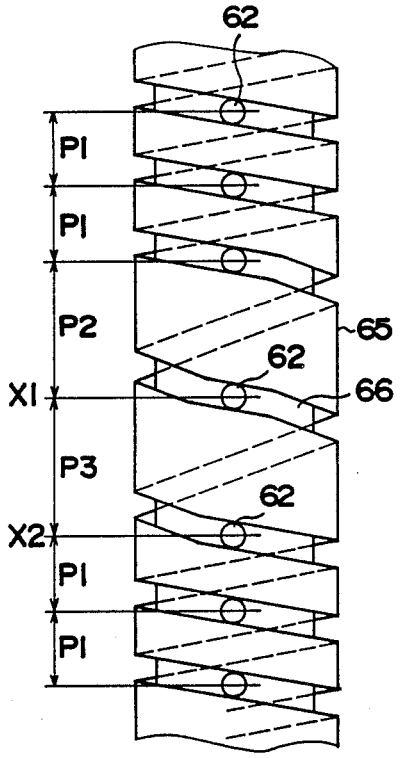
FIG. 4 is an enlarged explanatory drawing showing a spiral cam.

As shown in FIGS. 3 and 4, the four spiral cams 65 individually having a spiral cam groove 66 formed on the peripheral surface thereof are attached straight in the vertical direction at the front and rear on both sides of each bin 61, and rotated by a motor (not shown) capable of forward and reverse rotation. Each of the bins 61 has four trunnions 62 protruded at the front and rear on both sides thereof, each of which engages one of the cam grooves 66, whereby the bins 61 are held in a sloping state wherein the downstream side of the bins 61 relative to the sheet storing direction are elevated One rotation of the respective spiral cams 65 in the direction of the arrow (c) as shown in FIG. 3, lowers each of the bins 61 by one pitch, and one rotation in the direction reverse to the arrow (c) elevates each of the bins 61 by one pitch Each pair cf guide plates 69 and 69 has one of the trunnions 62 between them to guide the vertical movement of the bins 61.

In the case of sheet storing, at first the top bin 61 is set at the position (X1) facing the sheet delivering portion (A) in FIG. 2. Every time the sensor Sel detects that one sheet has been stored into one of the bins 61, the spiral cams 65 are rotated once in the direction reverse to the arrow (c), thus elevating the whole of each of the bins 61 by one pitch This allows sheets to be stored into one of the bins 61 sequentially from the top bin 61 to the bottom bin 61. On the other hand, when the stapling operation gets started after the completion of the distribution and storage of sheets, the bottom bin 61 having one set of sheets stored therein, for example, the fifth bin 61, in the case of employing five bins 61 for the sorting operation, is set at the position (X2) facing the sheet taking out portion (B). Every time one set of sheets is taken out of one of the bins 61 by the sheet take out unit 80 described below, the spiral cams 65 are rotated in the direction of the arrow (c), thus lowering the whole of each of the bins 61 by one pitch. This allows sets of sheets to be taken out of one of the bins 61 sequentially from the bottom bin 61.

In this case, one rotation of the spiral cams 65 is controlled by detecting the notch of a round plate 67 secured onto the bottom portion of a cam's axle by means of a photosensor Se2.

In addition, in this embodiment, each space between the bins 61 is arranged so as to become wider at the sheet delivering and taking out portions (A) and (B). This arrangement is provided so that each space between the bins 61 is allowed to be narrowed as possible at another position, thereby obtaining a small-sized sorter-finisher. At the same time, this arrangement is provided so as to ensure the delivery of sheets from the transport unit 50 to each of the bins 61, as well as to allow sheets to be smoothly taken out of each of the bins 61.

Therefore, as shown in FIG. 4, the cam grooves 66 are formed so that the pitches (P2) and (P3) [P2=P3] of the portions for setting each of the bins 61 at the sheet delivering and taking out positions (Xl) and (X2) are larger than that (P1) of the respective portions for setting each of the bins 61 at another position.

Figure 5:
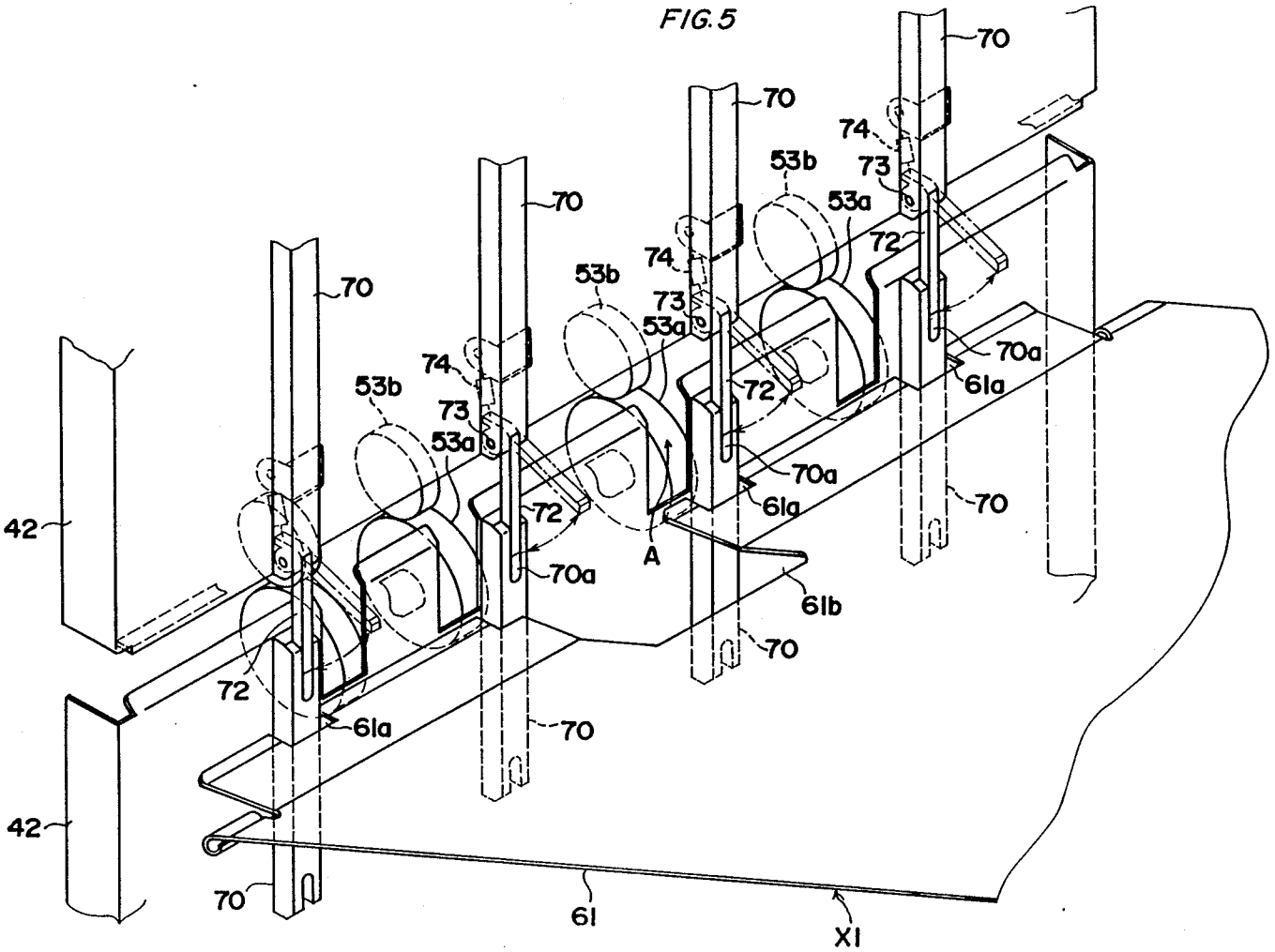
FIG. 5 is a perspective view of a sheet delivering portion.
Figure 6:
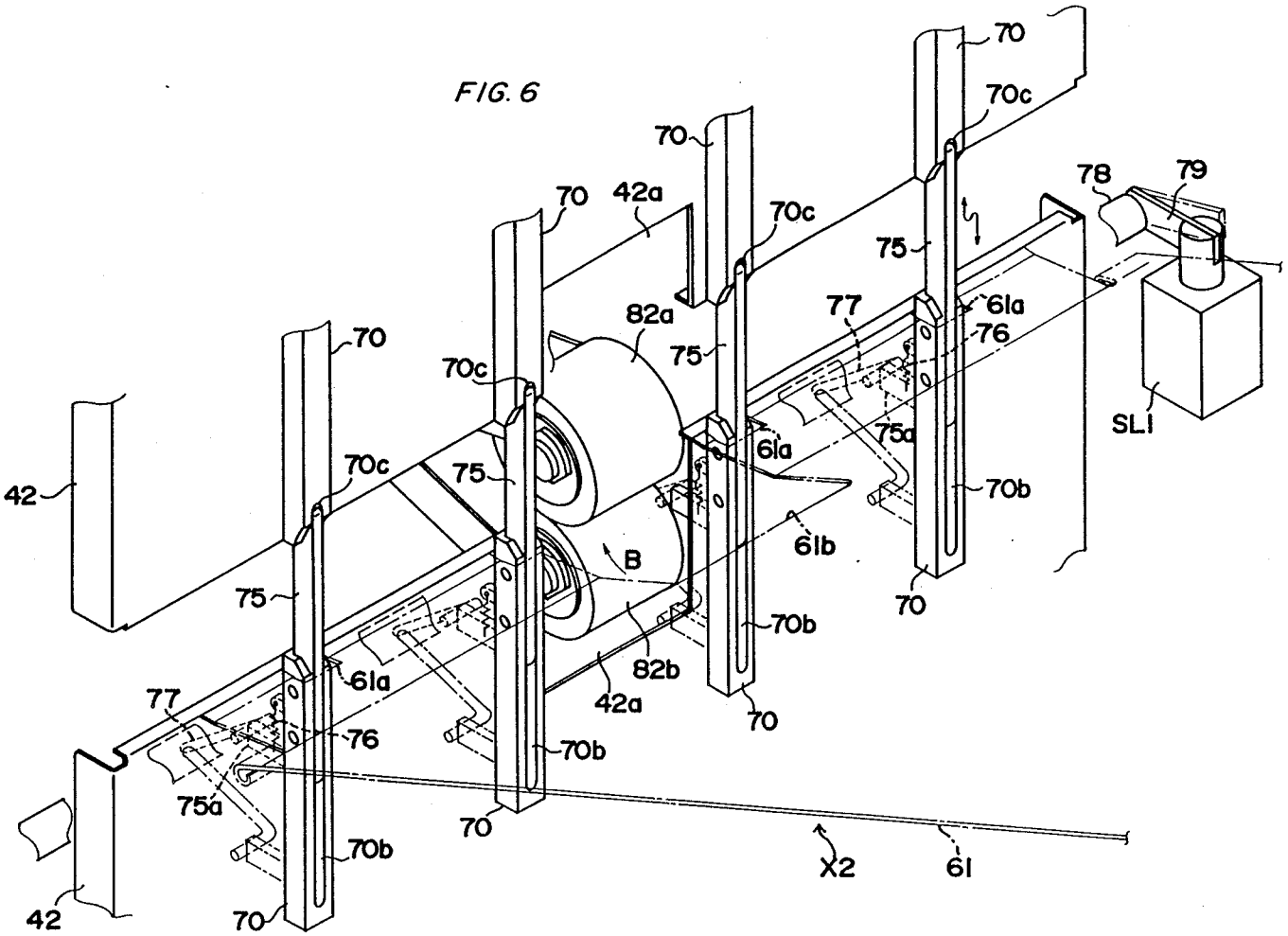
FIG. 6 is a perspective view of a sheet taking out portion.
Figure 7A:
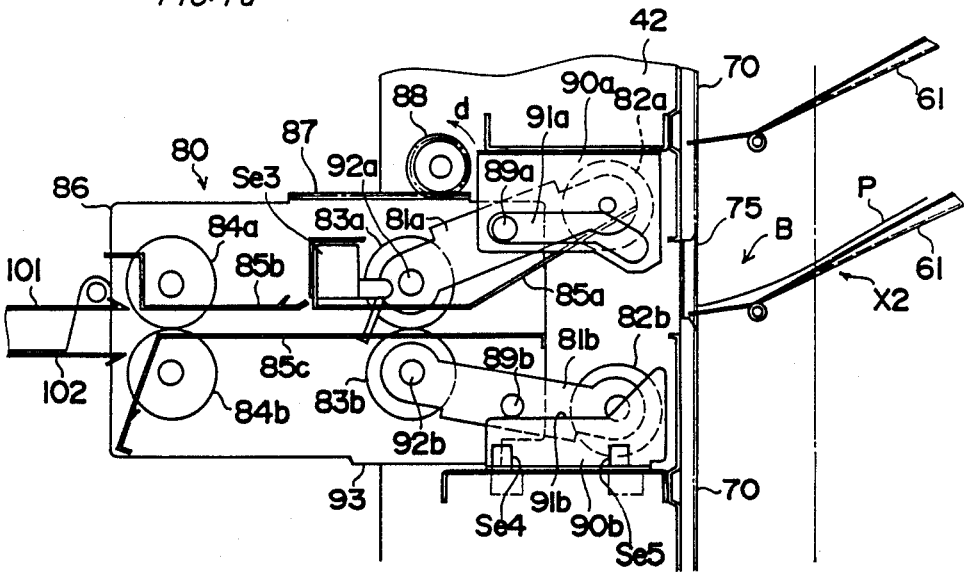
Figure 7B:
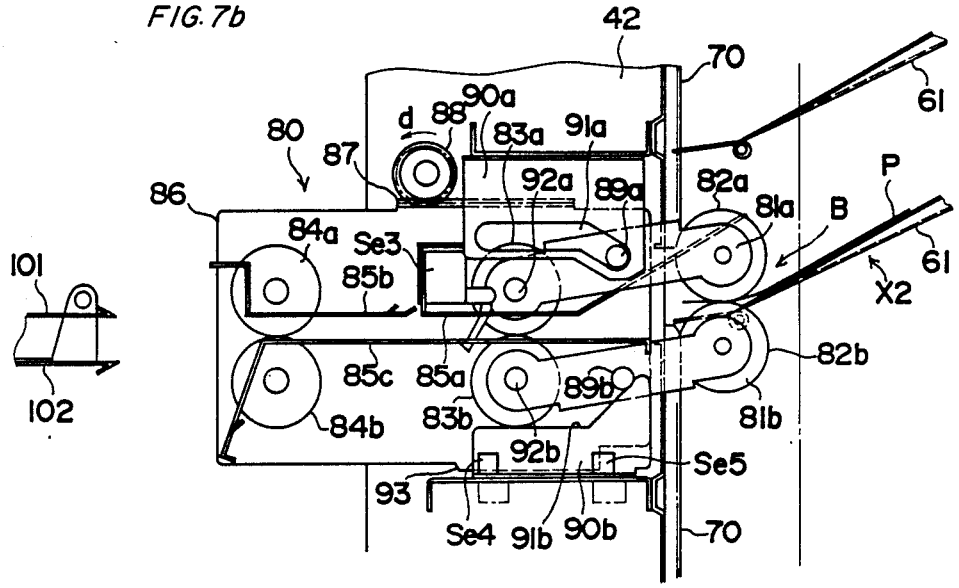
Figure 7C:
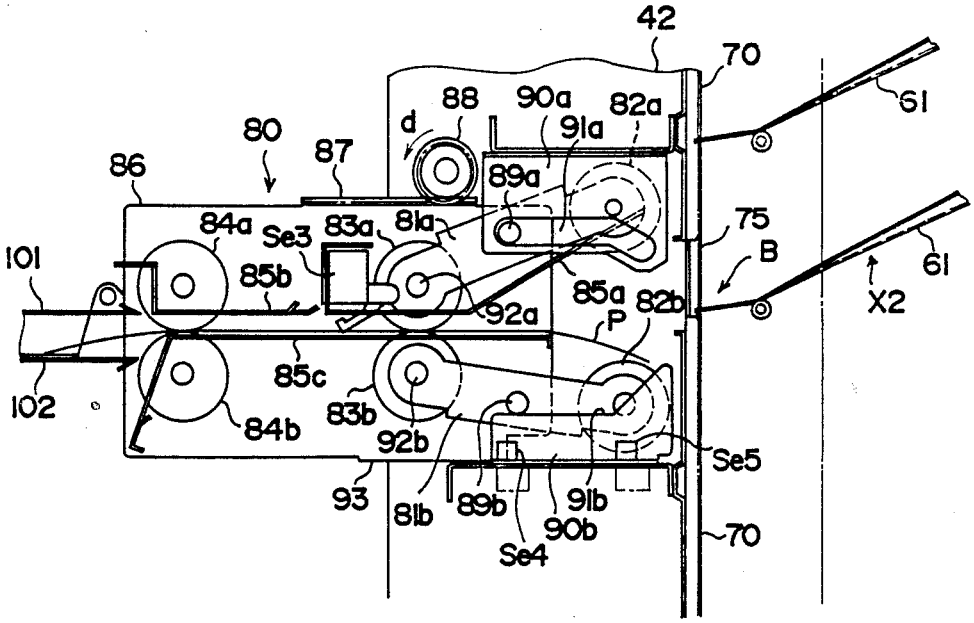

On the other hand, a plurality of guiding members 70 for preventing sheets from sliding down are attached onto the frame 42 in the vertical direction in the form of ribs, wherein they are crossed with notches 61*a* formed at the rear end of each bin 61 as shown in FIGS. 5 and 6. These guiding members 70 for preventing sheets from sliding down regulate the rear ends of sheets having already been stored on each of the bins 61, covering the range of the vertical movement of the bins 61, whereby the sheets are prevented from sliding down due to the slope of each of the bins 61.

At the sheet delivering and taking out portions (A) and (B), each of the guiding members 70 is divided to provide gate members 72 and 75 for delivering a sheet and for taking out one set of sheets, where the gate members 72 and 75 are provided.

As shown in FIG. 5, each gate member 72 is pivotally movable on each pivot 73 in a vertical plane, and is set by the drawing force of each coil spring 74 in a state wherein its end is inserted in each slot 70*a* of the guiding members 70. When set in this state, the gate members 72 close the sheet delivering portion (A) to function as an element for preventing sheets from sliding down. Meanwhile, in the case of sheet delivering, the gate members 72 are pivotally moved to the position, shown by the long and short dash line in FIG. 5, to release the sheet delivering portion (A) by the pressing force of a sheet.

With each guiding member 70, as shown in FIG. 6, another each gate member 75 is attached in each slot 70*b* of the lower section of the guiding members 70 so as to move along the slots 70*b*, and is set by the drawing force of each coil spring 76 in a state wherein the top end of each gate member 75 is inserted in each slot 70*c* of the upper section of the guiding members 70. When set in this state, the gate members 75 close the sheet taking out portion (B) to function as an element for preventing sheets from sliding down. Further, each projection 75*a* of the gate members 75 is connected via each lever 77 to the axle 78, whose end portion is connected to a solenoid SL1 via a lever 79. Therefore, when the levers 77 are pivotally moved down by turning on the solenoid SL1, the gate members 75 are moved down into the slots 70*b* to release the sheet taking out portion (B). The release of the sheet taking out position (8) is performed at the timing when the sheet take out unit 80 described below takes one set of sheets out of each of the bins 61.

As shown in FIGS. *7a*, *7b* and *7c*, the sheet take out unit 80 comprises take out rollers 82*a* and 82*b* held by arms 81*a* and 81*b*; sheet transport rollers 83*a*, 83*b*, 84*a* and 84*b*; guide plates 85*a*, 85*b* and 85*c*; a sheet detection sensor Se3 provided near the rollers 83*a* and 83*b*; and a holding plate 86 for holding these elements.

Each roller 82*a*, 82*b*, 83*a*, 83*b*, 84*a* and 84*b* are made of an elastic material such as a sponge material so as to absorb the thickness of one set of sheets superposed upon one another, and rotated by an unshown motor so as to transport one set of sheets to the left in FIG. *7a*.

The holding plate 86 is free to move in the horizontal direction through an unshown guide member, wherein a rack 87 formed upon the top surface thereof engages with a pinion 88 for output of an unshown motor. The forward/reverse rotation of the pinion 88 allows the holding plate 86 to move from the waiting position as shown in FIG. *7a* to the sheet taking out position as shown in FIG. *7b*, whereby the holding plate 86 returns to the position as shown in FIG. *7c* for transporting one set of sheets to the stapling unit 100.

The arms 81*a* and 81*b* for holding the take out rollers 82*a* and 82*b* are supported by axles 92*a* and 92*b* of the rollers 83*a* and 83*b* so as to pivotally move in a vertical plane. A pin 89*a* provided to the upper arm 81*a* engages with a cam slot 91*a* of a bracket 90*a* secured onto the frame 42. A pin 89*b* provided to the lower arm 81*b* engages with a cam surface 91*b* of a bracket 90*b* secured onto the frame 42.

When the sheet take out unit 80 constituted as mentioned above is at the waiting position, as shown in FIG. *7a*, the pins 89*a* and 89*b* are positioned at the left ends of the cam slot 91*a* and cam surface 91*b*, whereby the take out rollers 82*a* and 82*b* are largely separated from each other in the vertical direction. In this case, each gate member 75 closes the sheet taking out portion (B), and stops the end of one set of sheets stored on the bin 61 set at the sheet taking out position (X2). The sheet taking out action is started by rotating the pinion 88 in the direction of the arrow (d), whereby the holding plate 86 is moved to the sheet taking out position as shown in FIG. *7b*. In this case, the pins 89*a* and 89*b* are moved to the right ends of the cam slot 91*a* and cam surface 91*b*. The take out rollers 82*a* and 82*b* also correspondingly are moved down and up toward the right, defining an arciform curve, and gone into between the gate members 75 to catch the end portion of one set of sheets. The state of the take out rollers 82*a* and 82*b* at this moment is also illustrated in FIG. 6. In order to enable the rollers 82*a* and 82*b* to catch one set of sheets, a notch 61*b* is formed at the end of each bin 61, and notches 42*a* and 42*a* are provided to the frame 42.

Then, the solenoid SL1 is turned on to allow each gate member 75 to release the sheet taking out portion (B), and each roller 82*a*, 82*b*, 83*a*, 83*b*, 84*a* and 84*b* is simultaneously rotated to transport one set of sheets (P) to the left in FIG. *7b*. When the leading edge of the sheets (P) is detected by the sensor Se3, the pinion 88 is rotated in the direction reverse to the arrow (d), whereby the holding plate 86 is moved to the left together with the rollers 82*a* and 83*a* etc. to return to the waiting position (refer to FIG. *7c*). In this case, the ends of the guide plates 85*b* and 85*c* face the inlet portion of the guide plates 101 and 102, whereby the one set of sheets (P) is transported from the rollers 84*a* and 84*b* into the stapling unit 100 When the trailing edge of the sheets (P) are detected by the sensor Se3, each gate member 75 closes the sheet taking out portion (B) again.

The waiting and sheet taking out positions as well as the timing of the movement to each position, of the sheet take out unit 80, are detected by the sensors 8e4 and Se5. The sensors 8e4 and 8e5 are disposed in the movement course of a projection 93 provided on the holding plate 86. The projection 93 releases and closes the sensor's optical path, whereby the sensors Se4 and Se5 correspondingly detect the waiting position and the sheet taking out position.

As shown in FIG. 2, the rollers 84b are held by a bracket 95 movable up and down and connected to a solenoid SL2. At the last stage of transporting one set of sheets into the stapling unit 100 described below, when the solenoid SL2 is turned on, the rollers 84b are moved back to the lower position shown by the arrow (c) to allow smooth delivery of sheets.

As shown in FIG. 2, the stapling unit 100 comprises guide plates 101 and 102 for receiving one set of sheets transported through the sheet take out unit 80; a staple tray 105 to which an unshown vibrating unit is attached so as to align one set of sheets; a reference guide plate 106 and a aligning guide plate 107 positioned to both sides of one set of sheets transported onto the staple tray 105; a stopper 109; and a stapler 110. The stapling unit 100 slopes downward as a whole, wherein the stapler 110 is positioned at the bottom end thereof.

The guide plates 101 and 102 movable up and down on a pivot 103 can pivotally move from the position of the solid line to the position of the dash line in FIG. 2. When one set of sheets is transported into the stapling unit 100 through the sheet take out unit 80, the leading edge of the sheets is guided toward the top portion of the staple tray 105 by the guide plates 101 and 102, both being located at the position defined by the solid lines. When the trailing edge of the sheets is separated from the rollers 84a and 84b, the solenoid SL2 is turned on to allow the lower rollers 84b to move down. At the same time, the guide plates 101 and 102 are pivotally moved to the position of the dash line, whereby the one set of sheets is placed on the staple tray 105. In this case, the lower guide plate 102 and the tray 105 are positioned almost in the same plane.

The aligning guide plate 107 is allowed to move in the widthwise direction of one set of sheets placed on the staple tray 105. When one set of sheets is placed on the staple tray 105, the aligning guide plate 107 is moved toward the reference guide plate 106 on the opposite side from the waiting position exceeding the sheet width to the position corresponding with the sheet size, so as to align the one set of sheets in the widthwise direction. Simultaneously, the staple tray 105 is vibrated by the vibrating unit for a fixed time or for a time corresponding to the number of sheets to ensure the alignment of sheets. The leading edges of the sheets interferes with the stopper 109, whereby the sheets are aligned in the lengthwise direction.

The stopper 109 is allowed to pivotally move by an unshown solenoid, but is usually positioned at the bottom end of the staple tray 105 to regulate the leading edges of sheets. When one set of sheets is stapled by the stapler 110 described below, the solenoid is turned on to allow the stopper 109 to move back to the position of the dash line shown in FIG. 2, whereby the stapled sheets fall into a stack tray 121 because of their own weight.

Figure 8:
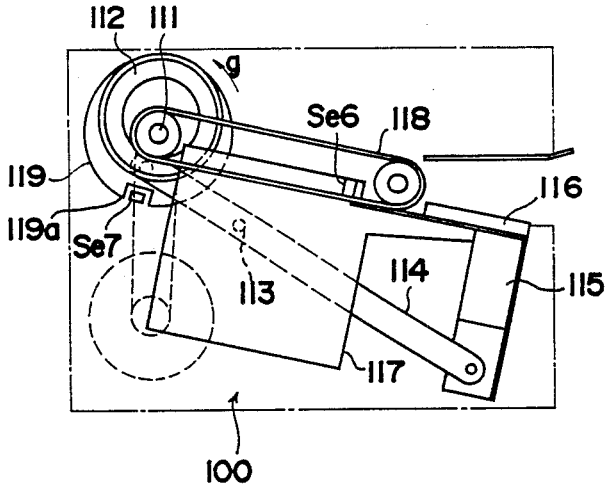
FIG. 8 is a plan view of a stapler.

As shown in FIG. 8, with the stapler 110, a head 115 is connected to the peripheral portion of a cam 112 secured onto a motor output axle 111 by an arm 114 pivotally movable on a pin 113. When the cam 112 is rotated in the direction of the arrow (g) by the motor, the head 115 is moved upward via the arm 114, whereby staples 116 staples one set of sheets aligned on the staple tray 105. Staples 116, which are stored in a cartridge 117, are fed to the head portion through a belt 118 rotated by the output axle 111.

In addition to the stapler 110, a photo-sensor Se6 for detecting that no staple is stored in the cartridge 117 as well as a photo-sensor Se7 for detecting the number of rotations of the motor are attached; wherein the sensor Se6 directly detects staples 116, and the sensor Se7 detects a notch 119a of a round plate 119 secured onto the output axle 111 so as to monitor the rotation of the motor.

The stapling operation of the above stapling unit 100 is repeated every time each of the bins 61 is lowered to the sheet taking out position (X2) by the spiral cams 65 and one set of sheets is transported in the staple tray 105 through the sheet take out unit 80 to be aligned.

The stack unit 120 comprises a stack tray 121 and a guide plate 122. When the stopper 109 is moved back from the bottom end of the staple tray 105, one set of sheets having been stapled by the stapler 110 fall because of its own weight to be stacked and stored on the stack tray 121.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A sorter-finisher attachable to an image forming apparatus, comprising:

a guiding member extending in a substantially vertical direction;

a plurality of bins movable in the vertical direction along said vertical guiding member, each bin including an inclined sheet holding surface for holding sheets thereon, one end of each bin opposed to said guiding member being lower than the other end;

a first opening, provided at a first position of said guiding member, through which first opening sheets ejected from the image forming apparatus may be selectively fed into each of said bins when the bin is located opposite to the first opening;

a second opening, provided at a second position of said guiding member, through which second opening sheets held in each of said bins may be taken out when the bin is located opposite to the second opening;

a stapling device for stapling the sheets taken out through said second opening;

a first gate member provided at said first opening and movable from a closing position where the first gate member closes the first opening to an opening position where the first gate member is out of the first opening; and a second gate member provided at said second opening and movable from a closing position where the second gate member closes the second opening to an opening position where the second gate member is out of the second opening.

2. The sorter-finisher as claimed in claim 1, wherein said second opening is located below said first opening.

3. A sorter-finisher attachable to an image forming apparatus, comprising:

guide means extending in a substantially vertical direction;

a plurality of bins movable in the vertical direction along said guide means, said bins adapted to hold sheets thereon;

a first opening, provided at a first position of said guide means, through which first opening sheets ejected from the image forming apparatus may be fed into each of said bins when the bin is located opposite the first opening;

a second opening, provided at a second position of said guide means, through which second opening sheets held in each of said bins located opposite the second opening may be taken out;

a stapling device for stapling the sheets taken out through said second opening;

first gate means provided at said first opening and movable from a closed position where the first gate means closes the first opening to an opening position where the first gate means is out of the first opening; and second gate means provided at said second opening and movable from a closing position where the second gate means closes the second opening to an opening position where the second gate means is out of the second opening.

4. The sorter-finisher as claimed in claim 3, wherein said second opening is located below said first opening.

* * * * *